United States Patent [19]

Burkett

[11] 4,375,889

[45] Mar. 8, 1983

[54] TRAFFIC BOARD GAME APPARATUS

[76] Inventor: Nora A. Burkett, 12728 Monica, Detroit, Mich. 48238

[21] Appl. No.: 814,450

[22] Filed: Jul. 11, 1977

[51] Int. Cl.[3] ..... A63F 3/00

[52] U.S. Cl. ..... 273/254

[58] Field of Search ..... 273/254, 251, 252

[56] References Cited

U.S. PATENT DOCUMENTS

| | | | |
|---|---|---|---|
| 1,085,371 | 1/1914 | Watterson | 273/251 |
| 1,346,826 | 7/1920 | Huggins | 273/254 |
| 1,455,045 | 5/1923 | Conde | 273/252 |
| 1,505,071 | 8/1924 | Fraser | 273/252 |
| 2,163,011 | 6/1939 | Schaub | 273/252 |
| 2,239,779 | 4/1941 | Clark et al. | 273/254 |

FOREIGN PATENT DOCUMENTS

| | | | |
|---|---|---|---|
| 525521 | 8/1940 | United Kingdom | 273/254 |
| 709543 | 5/1954 | United Kingdom | 273/252 |

*Primary Examiner*—Richard C. Pinkham
*Assistant Examiner*—Scott L. Brown
*Attorney, Agent, or Firm*—Basile, Weintraub & Hanlon

[57] ABSTRACT

A game in which the flow of traffic is simulated and in which a game board is imprinted with multiple streets running across the game board from one section to another and also at right angles thereto. The game includes cooperable pieces in the form of cards and game pieces in a unique form and appearance that enable, through playing of the game, the acquisition by the respective players of knowledge of vehicular and pedestrian traffic rules.

2 Claims, 20 Drawing Figures

Fig-6D

CITATION

PEDESTRIAN

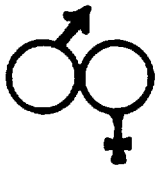

1

Fig-6E

CITATION

BICYCLE

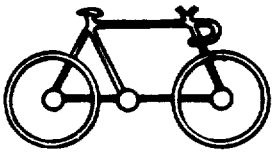

1

Fig-6F

CITATION

GOOD DRIVER

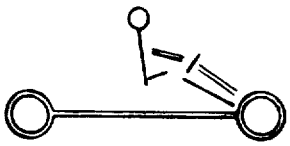

1

Fig-6G

CITATION

ASANTE, MIMMUM, SHNOR-
HAGAL, YEM TZEZ, KUDA WHYO
HA, BLAGODARYA, VI, TO HSEIH,
TAK, DANKU, DANKE SCHON, EFKHARIATO,
MERCI, RADAH, KOSSZONOM, GO
TODAH, MAIWAGAT, GRAZIO, ARIGATO
RAIW, MAIWAGAT, THANK TAKK, ILTIFAT-
MIN ZHTAMINATA YOU DZIE KUJE,
I-SHUMA ZIYAD, MULTEM ESC, GPASIBO,
OBRIGADO, GRACIAS TACK MINTA
HVALA, MINNOKH, SIZE TESHEKKUR
EDERIUM, DIOLCH

COURTESY 1

Fig-6H

PEDESTRIAN FAIL TO COMPLY WITH YELLOW OR RED SIGNAL-VEHICULAR TRAFFIC

FINE $5.00

1

Fig-6I

DISREGARD TRAFFIC SIGNAL

FINE $20.00

1

Fig-6J

A PROPER ATTITUDE FOR SAFE DRIVING AS BEING "SOCIALLY ACCOUNTABLE"

EXTRA MILEAGE MARKER

1

Fig-6K

HELPING HANDICAPPED PERSON IN DISTRESS

EXTRA SPIN

1

TRAFFIC BOARD GAME APPARATUS

CROSS REFERENCE TO RELATED APPLICATIONS

The present patent application is a continuation-in-part patent application of co-pending U.S. patent application Ser. No. 724,515 filed Sept. 20, 1976, U.S. Pat. No. 4,054,289, for "BOARD GAME APPARATUS."

BACKGROUND OF THE INVENTION

I. Field of the Invention

The present invention relates to an improvement in amusement games and, in particular, the present invention relates to a new and useful improvement in amusement games of educational and instructive character, which are instructive with respect to vehicular and pedestrian traffic rules and penalties associated with the violation of such rules.

II. Description of the Prior Art

While many educational and amusing games have been devised which, as their primary purpose, employ a game board to permit the participants to play a game which simulates some real aspect of life and, in particular, the acquisition of knowledge relating to vehicular and pedestrian traffic rules, the applicant is not aware of any game which utilizes a game board having a plurality of intersecting streets imprinted thereon and utilized in the manner proposed in applicant's invention. Further, while certain of the prior art games have provided entertainment and intellectual challenge, the applicant knows of no such game which involves the substantial interest, mental stimulation, strategy, educational experience, and enjoyment which is provided by applicant's game.

Examples of the prior art which are known to applicant are U.S. Pat. Nos. 2,268,433; 3,765,680; 3,892,408; and 3,924,858. The following patents were cited in the aforementioned copending United States patent application: U.S. Pat. Nos. 1,346,826; 2,239,779; and 3,765,680; and United Kingdom Pat. Nos. 525,521; 709,543, and 723,363.

III. Prior Art Statement

In the opinion of applicant, the aforementioned patents represent the closest art of which applicant is aware.

SUMMARY OF THE INVENTION

The present invention, which will be described subsequently in greater detail, comprises a game in which the flow of traffic is simulated. The game comprises a game board having imprinted thereon multiple streets running across the game board from one side to the other and at right angles thereto. In carrying out the invention, the game board is imprinted to represent a geographical section of a city with its different traffic zone sections and its street signs, traffic control devices, businesses, fire hydrants, parking meters, public buildings, residential property, and the like. The playing board is used by a plurality of players which are supplied with playing pieces in the form of cards and rectangular cubes which represent the vehicle plates that are moved from a starting position upon the game board, through the streets, with the player accumulating the highest number of mileage marker points upon reaching the finish line and winning the game.

It is therefore an object of the present invention to provide a new and improved game to be played by a plurality of opposing players, and which is instructive with respect to vehicular and pedestrian traffic rules.

It is a further object of the present invention to provide such a new and improved game in which the skill and judgment on the part of the players are advanced, yet the game is one which may be played and enjoyed by both children and adults alike.

Other objects, advantages and applications of the present invention will become apparent to those skilled in the art of games when the accompanying description of one example of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 6D is a top plan view of one example of a pedestrian card (aqua color with contrasting print);

FIG. 6E is a top plan view of one example of a bicycle card (royal blue with contrasting print);

FIG. 6F is a top plan view of one example of a good driver card (milk chocolate with contrasting print);

FIG. 6G is a top plan view of one example of a courtesy gas card (rose pink with contrasting print); FIG. 6H is a top plan view of one example of a pedestrian card;

FIG. 6I is a top plan view of one example of a traffic signal card;

FIG. 6J is a top plan view of one example of an extra mileage marker card;

FIG. 6K is a top plan view of one example of a reward card; and

DESCRIPTION OF THE PREFERRED EMBODIMENT

Figure 1A:
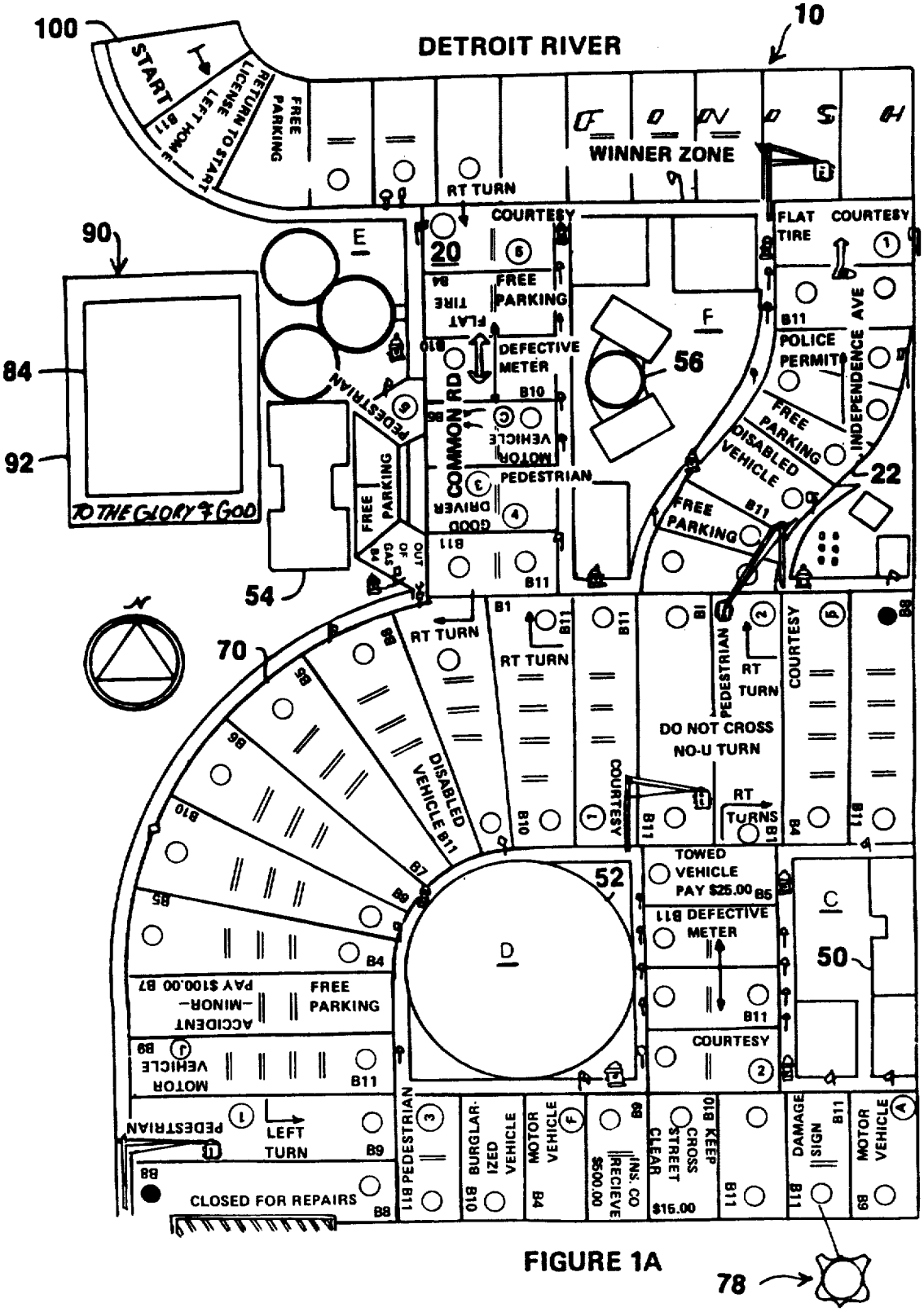
FIG. 1A is a top plan view of the left-hand portion of a playing board forming part of the inventive game.
Figure 1B:
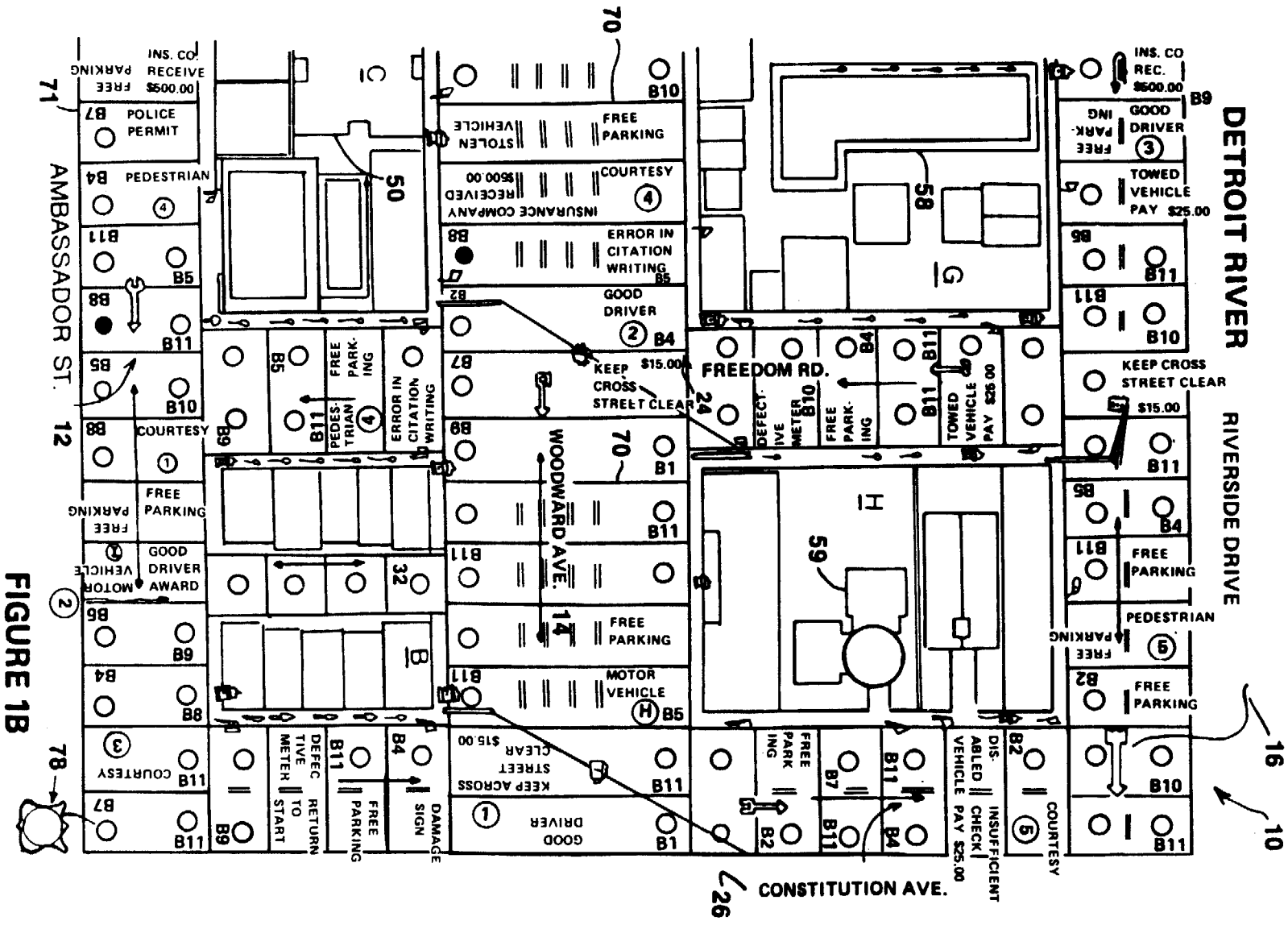
FIG. 1B is a top plan view of the mid portion of the playing board forming a part of the inventive game.
Figure 1C:
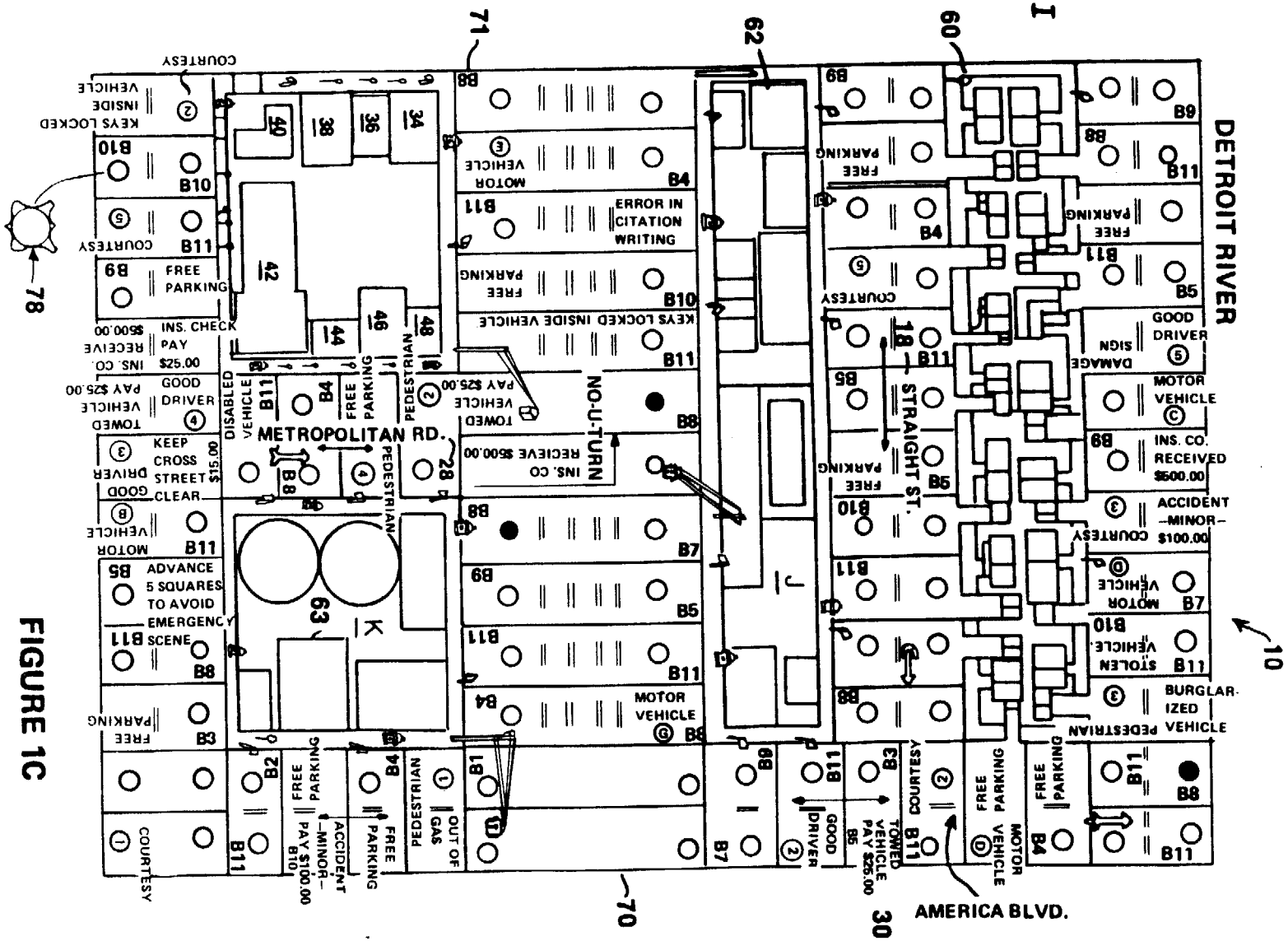
FIG. 1C is a top plan view of the right-hand portion of the playing board forming a part of the inventive game.

Referring now to the drawings and, in particular, to FIGS. 1A, 1B and 1C wherein there is illustrated in detail a playing board 10 delineated to represent on a reduced scale a map, as of a city, showing the streets, signs, posted traffic control devices, fire hydrants, parking meters, buildings, businesses, and the like. The board 10 is normally designed to be folded into three parts (the middle board being stationary) and is preferably no smaller than 20×36 inches when opened (no larger than 20×40 inches). The board 10 illustrates four east-west streets; namely. Ambassador Street 12, Main Street 14, Riverside Drive 16, and Colonial Street 18. North-south streets are designated as Common Street 20, Independence Avenue 22, Freedom Road 24, Constitution Avenue 26, Metropolitan Drive 28, America Boulevard 30, and an alley 32. The intersecting streets define a total of eleven blocks, which are meant to be representative of a typical city arrangement. For example, block A, which is bordered by Ambassador Street 12, Main Street 14, Constitution Avenue 26, and Metropolitan Avenue 28, is meant to be illustrative of a typical street preferably having a furniture store at 34, an appliance store at 36, a supermarket at 38, a gas station at 40, a post office at 42, a savings and loan association at 44, a professional building at 46, and a real estate office at 48. Block B is similar to block A and is provided with a plurality of commerical stores, such as a pharmacy, a gift shop, and the like. Block C is representative of the downtown type of block having a hotel, a hospital, a parking lot, and similar structures designated by the numeral 50. Block D is representative of a major use of land in the form of a stadium, designated by the numeral 52.

Block E is representative of a city university 54. Block F is typical of a shopping center having a restaurant, a theater, and similar commercial establishments and is represented by the numeral 56. Block G has buildings complementary to the downtown area represented by block C and includes a shopping mall, court, auto dealers, service and municipal buildings, and the like, all of which are designated by the numeral 58. Block H has buildings which are associated with residential sections, such as medical, church, police and fire facilities, all of which are represented by the numeral 59. Block I is representative of residential homes 60, while block J has public facilities assocaited with such a residential section including schools, libraries, swimming facilities, and a high school, which are represented by the numeral 62. Block K has buildings which are associated with the residential section and includes a cultural or civic center and things of that nature, all of which are designated by the numeral 63.

Figure 3:
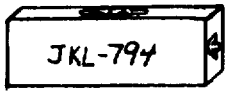
FIG. 3 is a perspective view of the face of one example of a playing element representative of a vehicle plate utilized in playing the game of the present invention.

It should be noted that each of the streets in FIGS. 1A, 1B and 1C is subdivided into a plurality of longitudinally aligned spaces 70 which are numbered such as at 71. The spaces 70 are sized to receive one or more playing pieces 72 (FIG. 3). The playing pieces 72 are in the form of license plates and represent vehicles. The playing pieces 72 are utilized by the participants in the game (white background represents passenger plates and cream background represents commercial plates), and each participant has one license plate and utilizes the same to simulate the driving of a vehicle traveling through the streets of a city. When a player, during the course of the game, stops on a pedestrian square, an automatic violation occurs; and a fine must be paid.

In the present game it is envisioned that a plurality of players would participate, the number of players ranging from a minimum of two to a maximum of ten. The playing pieces 72 are representative of the various types of vehicles commonly utilized, including passenger and commerical vehicles, such as automobiles, vans, convertibles, station wagons, motorcycles, bicycles, cabs, motor homes, out-of-state cars, handicapped, trucks, public official vehicles, and the like. The various playing pieces 72 are off-white and cream colored, preferably made of plastic cards that are arrow coded at each end to correspond with arrows on streets for designated travel. All vehicles must enter the alley.

Figure 2:
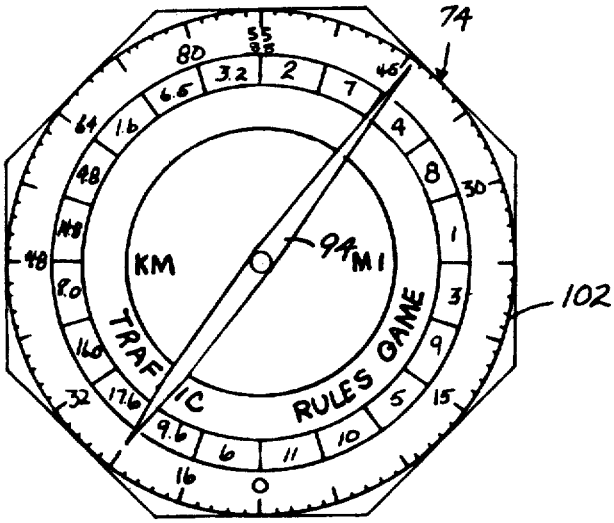
FIG. 2 is a top plan view of an octagon-shaped speedometer spinner utilized to determine, by chance, various numbers utilized in playing the game of the present invention.

FIG. 2 of the drawings illustrates an octagon-shaped speedometer spinner 74 which is utilized by the players to determined first choice of vehicle plates, first move, and also the number of moves made by playing piece 72, all of which will be described in greater detail hereinafter.

Figure 4:
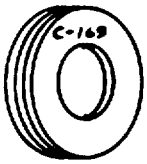
FIG. 4 is a perspective view of one example of a mileage marker game piece utilized in playing the game of the present invention.

FIG. 4 illustrates one example of a mileage marker 76, the use of which will be described in greater detail in the description of the manner in which the inventive game 10 is played. It is sufficient at this point to indicate that the mileage marker 76 is shaped to resemble a tire and has illustrated on one side thereof C-169. The players receive 12 (one extra) markers at the beginning of the game and retain a mileage marker for each block successfully passed without landing on a court appearance square. If an illegal move is noted by an opposing player, one mileage marker must be forfeited by the player who has been opposed. Each square is noted as 20 feet for strategy purposes in the game and will entitle each player to back up one to three moves (60 feet in all), rather than going forward to land on a more serious offense. Players, however, must not back around corners without the consent of opposing players. If a player lands on a good driver square, one extra mileage marker will be given to the player, provided the player does not have a suspended driver's license. If his license is suspended, the player is released from the suspension, but does not receive an extra mileage marker.

Figure 5:
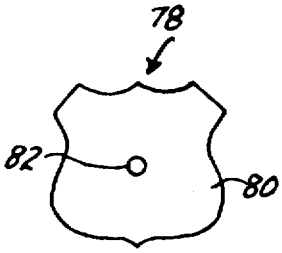
FIG. 5 is a somewhat enlarged plan view of the face of a badge shield which is imprinted on the game board illustrated in FIGS. 1A, 1B and 1C of the drawings.

FIG. 5 is an example of a color-coded, player directive symbol 78. A plurality of such symbols 78 are strategically located on the various streets and alley of the game 10. All of the symbols 78 are in the form of a shield 80 having a color-coded surrounding dot 82 in the center thereof. Because of space limitations, the symbols 78 are shown as circles in the drawings. During the game, as a player moves from square to square, he will from time to time land on a square containing a player directive symbol 78. Depending upon the type of symbol, as determined by its color code 82, the player will be penalized or rewarded in the manner that coincides with the playing cards or squares. There are three such player directive symbols 78. There are three badge color-coded shields; blue, gold, and red. The red shields represent a revoked license. Any player earning a revoked license is out of the game.

There are 27 player directive symbols. They are as follows:

1. Blue color-coded, player directive symbols (police violations). Player relinquishes a mileage marker upon landing on a suspended jail or probation square.

Figure 6C:
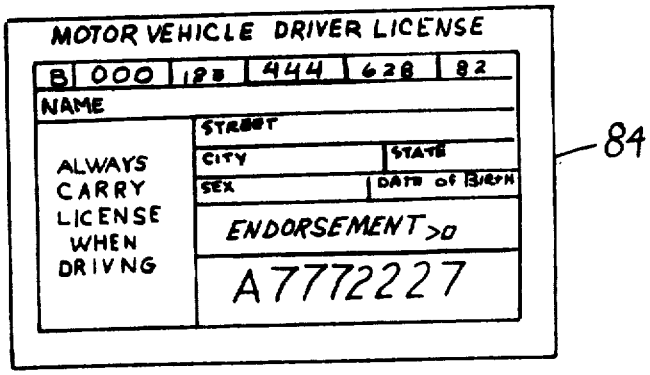
FIG. 6C is a top plan view of one example of a motor vehicle driver's license card (red with contrasting print)
Figure 6B:
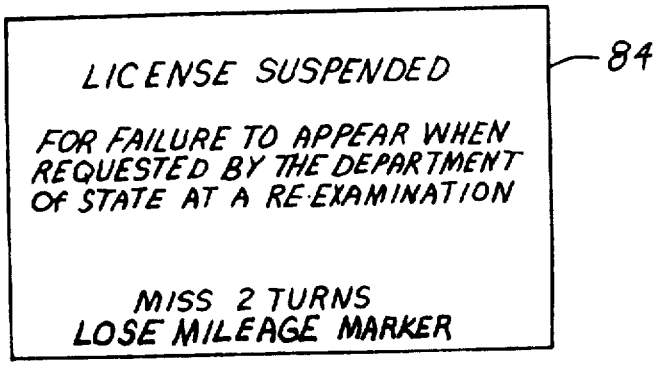
FIG. 6B is a top plan view of one example of a penalty card.
Figure 6A:
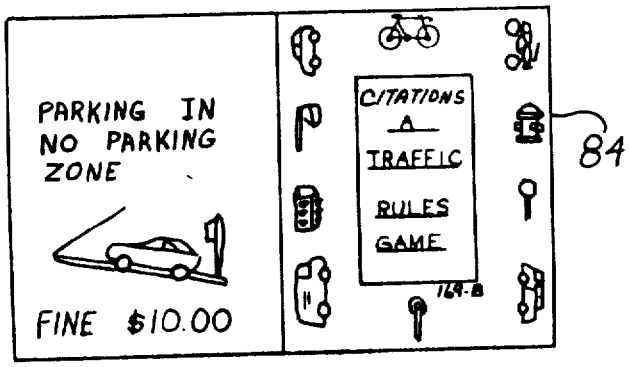
FIG. 6A is a top plan view of one example of Citation playing cards which, in various numbers, make up a deck of cards which are used cooperatively by the players of the game.

2. Gold color-coded, player directive symbols. When a player lands on a gold symbol 78, he receives a citation in the form of one of the playing cards 80 illustrated in FIG. 6A of the drawings, and which will be described in greater detail hereinafter. If a player lands on a good driver or courtesy square, any driver's license suspension is lifted. Additionally, jail and probation are terminated upon landing on courtesy square. Each time a player lands on a gold color-coded, player directive symbol 78, he draws one of the plastic coated playing cards 84 from a stack 90, which is located in the storage box 92 on the face of the game board 10. Each card will have an illustration of a violation. The player follows the directive set forth in the card. The directive generally consists of a fine; however, as will be explained hereinafter, there are other directives which the player must follow. Once the directive on the playing card has been followed, the playing card is placed in sequence in the stack 90.

3. Maroon color-coded, player directive symbols. These cards are illustrative of defective parking meters; and when a player lands in a space having this symbol, he may have an option to move to the next space or wait until the next turn for spinning and proceed with the game as if he had landed in that next space on this first move.

4. In a similar manner, the game inclues color-coded, player directive symbols which are color coded apricot for a defective vehicle, bronze copper for an error in writing a ticket, brown for a stolen vehicle, redwood rust for a flat tire, burnt orange for out of gas, sail blue for a police permit, tangerine for a burglarized vehicle, dark red for damage signs, slate blue for keys locked inside the vehicle, gray for free parking, green for start of game, sea green for keep cross street clear, and burgundy for insufficient check. Similar to the defective meter player directive symbols, each of these permits the player to have an option, when landing in the space having such a symbol, to move to the next space as if such next space had been the original landing spot for the player, if the player chooses to do so.

5. Yellow color-coded, player directive symbols designate a towed vehicle, and the player must pay the prescribed fee; for example, $25.00 for having his vehicle towed. If a player makes a prohibitive move or turn, he must forfeit a mileage marker.

6. Irish green color-coded, player directive symbols represent a payment from an insurance company; and upon landing in such a space having the Irish green color-coded, player directive symbol, the player receives $500.00 from the banker.

7. Beige color-coded, player directive symbols. When a player lands in a space having beige symbols, the player must return to the initial starting position 100 and commence to move therefrom—license at home.

8. Purple color-coded, player directive symbols designate that an accident has taken place, and the player must pay the fee of $100.00 to the bank.

9. Royal blue color-coded, player directive (bicycle cards and printed squares) symbols are designative for a bicycle player, and the player acts according to card number, if he lands therein.

10. Pink color-coded, player directive symbols provide the player with an extra turn; that is, he is permitted to spin the spinner 74 and move the amount of courtesy gas card spaces indicated thereby, as will be explained hereinafter.

11. Red color-coded, player directive symbols. When a player lands on one, the player is out of the game.

Referring now to FIG. 2 wherein there is illustrated the octagon-shaped speedometer spinner 74, which is constructed in accordance with the principles of the present invention and comprises a planar member 102 which on the right-hand peripheral side is numbered from 0 through 55 and is representative of miles per hour, while on the left-hand side there is numbered from 0 through 88, which is representative of kilometers per hour. While the numbering thereon is not particularly necessary for the operation of the game, it is provided as an educational means for the user to obtain a general relationship between miles per hour and kilometers per hour. Choice of vehicle plates is determined by the highest spinner at the beginning of the game. All pedestrian violations are subjected toward all players, who pay fines accordingly.

The octagon-shaped speedometer spinner is provided with a needle 94 that is pivotally mounted by suitable means to the center of the spinner 74 and is adapted to land in any one of a plurality of eleven squares, each of which is numbered respectively from 1 through 11 but in a random array from the bottom to the top of the spinner planer member 102. It can thus be seen that when a player spins the needle 94, the same will land in one of the spaces from 1 through 11. This determines the number of spaces the player may move his playing piece 72. At the beginning of the game each player spins the spinner needle 94, and his turn and choice of vehicle plates is determined by the position at which the spinner needle 94 lands. If two players should spin to the same number, the second player will spin the spinner needle 94 until it falls on a number which is his exclusively. During the course of the geame each player spins the needle 94, and the position at which the same lands determines the number of spaces the player will move his playing piece 72. It should be noted that the needle 94 is pointed at both ends so that it will always point to a number, irrespective of where it stops on the planar member 102.

The face of each card 84 illustrates features which have a relation to the game, and preferably each card 84 has printed thereon a motorbike, a fire hydrant, a van, a bicycle, a meter stall, a truck, a signpost, and a two-door passenger vehicle, stop sign and traffic light added. The back side of each of the cards 84 lists one type of offense which the player has committed with illustration and the fine or penalty which the player must pay for having committed the offense, not necessarily in sequence as listed below. It is through the playing cards 80 that the players learn the various traffic rules associated with driving, walking, and riding and the manner in which a person may be penalized for violating such rules. The various violations and fines associated therewith on the playing cards 84 are as follows:

| TYPE OF VIOLATION | FINE AND/OR PENALTY |
|---|---|
| Reckless Driving - no driving 90 days probation - 6 points on driving record, referred to Drivers Training School | $200.00 - Miss 3 turns |
| Careless Driving - (ordinary negligence) 45 days probation - 4 points on driving record, restricted to and from work | $50.00 - Miss 2 turns |
| Exceeding the lawful speed limit by 16 or more M.P.H. - 60 days probation | $100.00 - Miss 1 turn |
| No Operators License (never acquired) Jailed overnight - 5 day jail sentence | $200.00 - Miss 2 turns |
| Use of False License - jailed overnight - 30 days probation | $100.00 - Miss 3 turns |

-continued

| TYPE OF VIOLATION | FINE AND/OR PENALTY |
|---|---|
| Driving with open liquor bottle in compartment - 30 days probation, must visit morgue and write traffic safety report | $25.00 - Miss 3 turns |
| Disobeying Traffic Signal, Stop Sign, 30 days probation - 3 points on driving record | $20.00 - Miss 1 turn |
| Failure to yield right of way to vehicle legally in an intersection - 2 points on driving record | $25.00 - Miss 2 turns |
| Fail to show license to Officer, Jailed overnight | $25.00 - Miss 2 turns |
| Drive without Due Regard to Road Conditions (must listen to 3 days Court Cases, Re: traffic) 2 points on driving record | $50.00 - Miss 2 turns |
| Allowed another to use vehicle license plates - Jailed 3 days | $25.00 - Miss 2 turns |
| Operator's license not on person | $10.00 - Miss 1 turn |
| Interfering with closely approaching traffic | $20.00 |
| Failure to Signal on leaving curb | $10.00 |
| Exceeding 15 M.P.H. Speed limit in an alley | $20.00 |
| Fail to heed another vehicle signal | $10.00 |
| Driving to the left center of street | $10.00 |
| Following too closely | $20.00 |
| Open car door in traffic | $10.00 |
| Arm around passenger, one arm driving | $10.00 |
| Driving to the left of a divided roadway (wrong way) | $20.00 |
| Littering or spilling contents in streets | $20.00 |
| Failure to keep slow moving vehicle to right | $10.00 |
| Straddling traffic lane | $10.00 |
| Lap driving (person or animal) | $10.00 |
| Driving through private property | $10.00 |
| Driving a motor vehicle on or over sidewalk or curb | $10.00 |
| Trucks prohibited on parks and blvds. or commercial vehicle prohibited on certain streets | $10.00 |
| Board or Discharge Passengers, Street | $10.00 |
| Failure to stop at crosswalk, driveway, or alley | $15.00 |
| Failure to yield right of way for emergency vehicle (Police, Fire or E.M.S.) | $10.00 |
| Four in driver's seat | $10.00 |
| Pass or Overtake and Pass in Intersection | $20.00 |
| Improper U-turn | $15.00 |
| Passing on the right | $20.00 |
| Passenger outside vehicle (unless employment requires) | $15.00 |
| Splashing pedestrians on crosswalk or sidewalk | $15.00 |
| Parked within 30' of stop sign, posted | $5.00 |
| Failure to comply with Officer's signal | $20.00 |
| Backing without safe observation | $15.00 |
| Failure to signal on varying course of travel | $20.00 |
| Obstruction of traffic parked at street (excavation) | $15.00 |
| Person on bicycle attached to vehicle | $10.00 |
| Vehicle blocking crosswalk (paralled) | $15.00 |
| Backed into meter stall (angle) | $5.00 |
| Overlapping two meter stalls | $5.00 |

-continued

| TYPE OF VIOLATION | FINE AND/OR PENALTY |
|---|---|
| Overtime parking | $5.00 |
| Expired meter | $5.00 |
| Parked on private property without consent | $10.00 |
| Parked in public alley | $5.00 |
| Parked a commercial vehicle between 12:00 a.m. and 5:00 a.m. on any street more than 30 minutes | $5.00 |
| Abandoned vehicle (left over 48 hours) | $5.00 |
| Parked between lot line and curb | $5.00 |
| Parked or standing in Building Entrance (in use), posted | $15.00 |
| Parking overtime in pick-up zone | $5.00 |
| Leave motor running, vehicle unattended | $10.00 |
| Parking on shoulder of roadway or freeway (unless disabled) | $5.00 |
| Cutting in and out, or into traffic control devices and traffic street signs | $20.00 |
| Park or stand in Taxi zone | $5.00 |
| Parked in Bus Stop | $15.00 |
| Ignore right or left turn only signs or lanes | $10.00 |
| Parking within 20' of fire station | $5.00 |
| Parked within 20' of crosswalk | $5.00 |
| Parked within 15' of Fire Hydrant | $15.00 |
| Parked more than 12" from curb (either wheel) | $5.00 |
| Parked left wheel to curb except one-way streets | $5.00 |
| Parked, stand or stop in No Stopping zone | $15.00 |
| Standing in No Standing Zone | $15.00 |
| Parked on sidewalk (blocked) headed into driveway | $10.00 |
| Parked on street opposite entrance of fire station within 75' of fire station (must be posted) | $5.00 |
| Parked on sidewalk (either wheel) | $5.00 |
| Blocking private driveway | $15.00 |
| Parked within 5' of private driveway (10' curb cut or less) | $5.00 |
| Disregard School Crossing signal | $20.00 |
| Parked on crosswalk (overlap corner) | $5.00 |
| Use alley as through street | $10.00 |
| Parked or stand in No Standing zone | $15.00 |
| Parked or stand streetside of parked vehicle (double) | $15.00 |
| Parked in No Parking zone | $5.00 |
| Defective or insufficient lighting equipment | $10.00 |
| Operate a motor vehicle from outside the vehicle | $20.00 |
| Drive over Firehose, Firehose line | $10.00 |
| Parked adjacent to dividing area of blvd. or street | $5.00 |
| Back around corner without outside observer | $15.00 |
| Riding motorcycle or motor driven vehicle on sidewalks | $10.00 |
| Parked within 30' of flashing beacon or traffic control device | $10.00 |
| Pass to left of left turning vehicle | $20.00 |
| Fail to promptly remove stalled vehicle | $20.00 |
| Excessive noise (muffler, horn, exhaust pipes, or tires) | $10.00 |
| Fail to lock motor vehicle when | $10.00 |

-continued

| TYPE OF VIOLATION | FINE AND/OR PENALTY |
|---|---|
| leaving unattended | |

Red Badge on Board denotes:
License revoked for: Voluntary manslaughter (wanton recklessness) with a motor vehicle—*Out of Game*
License revoked for habitual drunkeness or drug addiction—*Out of Game*
Jail, suspension or probation is terminated upon landing on a good driver or courtesy square Bicycles must honor these following squares:
All bicycle citations
Pedestrians
Keep cross street clear
Courtesy and good driver also
Advance (5) squares to avoid an emergency scene
Last but not least, all traffic signals and street signs, Posted
Bicycles will have less monies in game.

Figure 7:
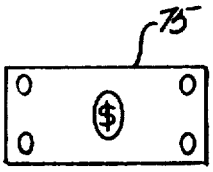
FIG. 7 is a top plan view of simulated currency or script money used in playing the game of the present invention (six graduated shades of green coloring for each denomination).

As aforementioned, each player spins the spinner 74 to determine his order of play and choice of vehicle plate. Once the order of play has been determined, each player, as his play comes up, spins the pointer 94 on the spinner 74 to determine the number of spaces he may move his playing piece 72. Upon landing on a red shield, the player is out of the game. As the play progresses, each player pays the fines with the money 75 (FIG. 7) received at the beginning of the game. It is preferred that each player receives $7000.00 in various denominations, such as $5.00, $10.00, $20.00, $50.00, $100.00 and $500.00 bills, the sum total in the game being $100,000.00. Each bicycle player receives $1500.00. The object of the game is to have the most mileage markers. A mileage marker is also obtained every time a player lands on a good driver square. No reward is given in the event a player has to return to the start 100. Jail and probation sentences are terminated upon landing on a good driver square.

The aforementioned playing pieces 72 represent the following types of vehicles, and such vehicles have the following street destinations which must be followed. Directional arrows coincide with vehicle plate ends, otherwise the player may proceed with legal turns on the board 10. Vehicles may interchange mobile directional arrows placed on each end of vehicle plates and follow said street destinations for the course of a game. No U-turn on Main Street.

The basic destination pattern for this game is as follows:

1. The four-door passenger and van vehicles with passenger plates must use Colonial Street between Constitution and America Boulevard (residential side) and use Independence Avenue to finish.
2. The bicycle and station wagon with passenger plates must pass on the school side of Colonial Street between Constitution and America Boulevard and use Common Street to finish.
3. The motorbike and handicapped two-door passenger plates must pass the school side on Colonial Street and use Common Street to finish.
4. The cab and out-of-state, two-door passenger plates must pass the residential side of Colonial Street and use Common Street to finish.
5. The truck and four-door commercial plates must pass on Main Street and American Boulevard intersection before using Independence to finish.
6. The motor home passengers and camper passengers must use the residential side of Colonial Street and use Independence to finish.
7. The two-door and station wagons (commercial) must pass the school side of Colonial Street and use Common Street to finish.
8. The two-door auto dealer plate and van with manufacturer plate vehicles must use Riverside Street before using Independence to finish.
9. The trailer truck and convertible with commercial plates must use America Boulevard and Main Street intersection and finish on Independence Avenue.
10. The convertible passenger plates and four-door public official vehicles (State, City and Government) on lunch hour must use Colonial Street (residential side) before using Common Street to finish.

Figure 8:
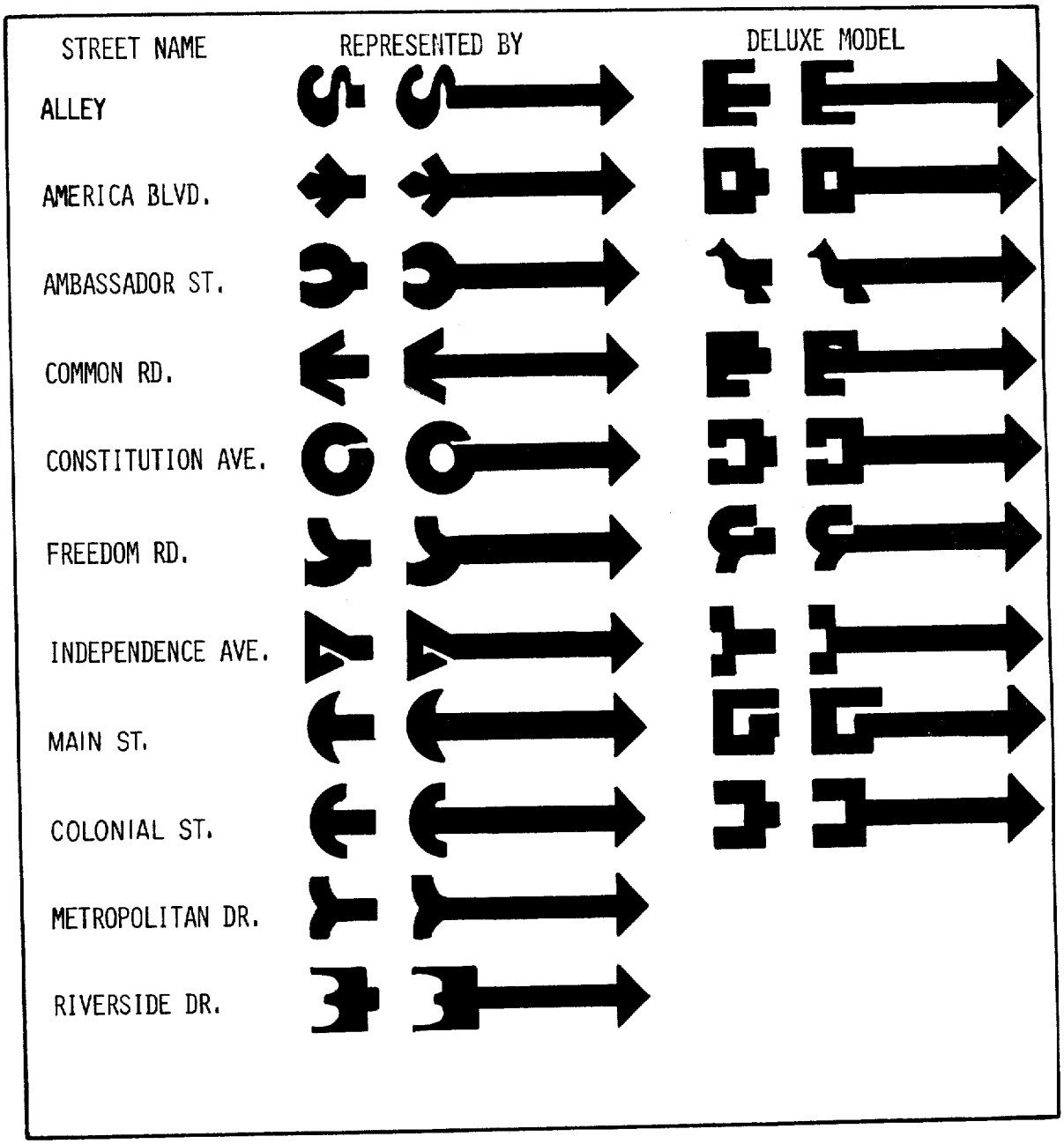
FIG. 8 is a chart illustrating the directional arrows.

The players may want to devise their own destination pattern by changing the ends of the directional arrows, but the players must use alley 32 in every game. The directional arrows have the designations shown in the chart of FIG. 8 of the drawings.

The player with the most mileage markers wins the game. If a game ends in a tie, the person who comes in first with the most mileage markers wins. If three or more players tie, then there is a playoff with the spinner 74, and the player with the highest number wins.

There are 27 square player directive symbols on the board, and the square symbols are color coded and are as follows: 50 Blue—Police (moving); 40 Gold—Parking Enforcement Assistant (parked, stand or stop); and 7 Red—Revoked (out of game).

SQUARES

1. Pedestrian violations—all fines $5.00
2. Courtesy gas card—extra spin
3. Good driver card—extra mileage marker
4. Motor vehicle card—suspended, probation or jail
5. Bicycle card—different violations and fines

SQUARES

1. Start
2. Free parking
3. Advance (5) squares to avoid an emergency scene
4. Keep cross street clear—pay $15.00
5. Return to start—forgot license (at home)
6. Towed vehicle—pay $25.00
7. Insurance company—receive $500.00
8. Keys locked inside vehicle
9. Insufficient check—pay $25.00
10. Accident (minor)—pay $100.00

VOID CITATION TRAFFIC CARDS

1. Error in citation writing
2. Damage signs
3. Defective meter
4. Police permit
5. Flat tire
6. Stolen vehicle
7. Out of gas
8. Disabled vehicle
9. Burglarized vehicle The cards 84 illustrated in FIGS. 6A through 6K are examples of the cards 84 used in the game and are as follows:

COURTESY SQUARE AWARD (Extra Spin)

1. Helping handicapped person in distress.
2. Assisting youngster across the street.
3. Seeking police, fire of E.M.S. for person in need.
4. Writing license number of hit and run driver.
5. Removing broken glass and debris from street without harm to self or interference with traffic (residential area preferred).

GOOD DRIVER AWARD (Extra Mileage Marker)

1. A proper attitude for safe driving as being "socially accountable."
2. A keenness to obey traffic laws and defensive driving.
3. A voluntary willingness to share the highway with others.
4. Full concentration on personal driving and traffic.
5. Consideration for persons at all times with due respect to all traffic laws.

PEDESTRIAN VIOLATIONS (All Fines below $5.00)

1. Pedestrian fails to comply with yellow or red signal in vehicular traffic.
2. Pedestrian fails to comply with wait (don't walk) signal (interference unnecessary).
3. Pedestrian crosses on crosswalk—interferred with closely approaching traffic (unsignalized intersection).
4. Pedestrian enters roadway—not on crosswalk; interferred with vehicular traffic.
5. Pedestrian walks in roadway—sidewalks provided.

MOTOR VEHICLE CARDS
(Suspended or Revoked)

| | | |
|---|---|---|
| 1. | License suspended for failure to appear when requested by the Department of State for re-examination | miss 2 turns |
| 2. | License suspended for mental or medical condition which might make it unsafe for person to operate a vehicle | miss 2 turns |
| 3. | License suspended for receiving a ticket during the first year of driving for thirty (30) days | miss 1 turn |
| 4. | License suspended for refusal to take blood alcohol content test when arrested for driving under the influence of alcohol or driving with ability impaired due to the influence of alcohol | miss 3 turns |
| 5. | License suspended for three convictions of reckless driving within twelve (12) months; also, forfeiture of bail for jumping bail | miss 3 turns |
| 6. | License suspended for failing to procure new plate for out-of-state vehicle within the allotted time | miss 1 turn |
| 7. | License suspended for failure to stop and identify self at scene of accident | miss 2 turns |
| 8. | License suspended for operating with unsafe vehicle (caused accident) | miss 2 turns |
| 9. | License suspended for failure to appear in court and pay, or otherwise settle, a moving traffic violation ticket | miss 1 turn |
| 10. | License suspended for operating a motor vehicle while ability impaired | miss 2 turns |

BICYCLE CARDS

Bicycles must obey all traffic signs and signals.

| | | |
|---|---|---|
| B-1. | Disregards traffic signal | $20.00 |
| B-2. | Ignores stop sign or yield right-of-way sign | $20.00 |
| B-3. | Ignores all other traffic signs | $10.00 |
| B-4. | Bicycle hitching on moving vehicles (Applies to all bicycle cards, 17 years and older) | $10.00 |
| B-5. | Bicycle failing to ride on right-hand side of street as close to the curb as possible | $10.00 |
| B-6. | Bicycles not allowed on freeways (Court appearance) -- miss 1 turn, plus write report on freeway accidents and visit to the city morgue | |
| B-7. | Bicycles on road after sunset must have strong front light and good rear reflector. Bicycles impounded for two turns, barring equipment repair | $25.00 |
| B-8. | Bicycle unsafe, improperly equipped. Impounded for two turns, barring equipment repair | $10.00 |
| B-9. | Prohibited turns (all); bicycles must signal with left hand prior to turn, while either slowing down or stopping | $10.00 |
| B-10. | Riding bicycle with more than two abreast | $10.00 |

Although not shown in the drawings, the following restrictions are printed on the board 10:

Beginning at start and making right turn only onto Common from Riverside Drive, traveling south to Main Street with another right turn only onto Main Street west, traveling south to Ambassador and detouring left onto Ambassador because of street repairs. West on Ambassador at Main Street north corner exists right turn only. Traveling east on Main at Independence on the southwest corner are no left turns or crossings. Traveling north on Independence Avenue on southeast corner is posted right turn or thru to Common Street, right only. On Freedom Road beginning at Riverside south exists a one-way street south with a thru or left turn only on the southwest corner. No left turns at Freedom Road and Main Street. Right or left turns are allowed at the intersection of Freedom Road and Ambassador Drive.

Constitution is a one-way street north with no left turns allowed throughout and a right turn only on the northeast corner of Main and Common Street.

The game may also include, in the deluxe model, additional features such as freeways, railroad crossings, more streets and violations, shaped vehicle plates, a magnifying glass to aid players, and a folder index which houses each card visibly.

It can thus be seen that the present invention has provided a new and improved game which will provide the players with fun, strategy, excitement, and challenge while being instructive with respect to vehicular and pedestrian traffic rules and the penalties for violating such rules, all of which challenges the skill and judgment of the players who are partaking in this strategy game.

While only one example of the present invention has been disclosed, it should be apparent to those skilled in the art of games that other forms of applicant's invention may be had, all coming within the spirit of the invention and scope of the appended claims.

What is claimed is as follows:

1. A traffic complaint rules game for pedestrians and vehicles comprising:

a game board having a plurality of intersecting streets imprinted thereon to symbolize a geographical section of a city, the streets dividing said board into a plurality of blocks with moving traffic and parking regulations that include stop signs, traffic control devices, fire hydrants, parking meters, public buildings, businesses and a residential section, subdivided into a plurality of numbered spaces; with traffic control devices, signposts, fire hydrants, parking meters, and pedestrian squares;

an inset card-holding tray carried by said game board on a portion adjacent one of said streets, for gold and blue coded cards;

a plurality of playing traffic violation cards disposed in said tray, each of said playing traffic violation cards being provided with indicia representing a traffic violation with illustrations and the fine associated with said violation;

a plurality of mileage markers indicative of a prescribed travel by a player along said streets of said game;

a plurality of playing pieces representing the vehicle as vehicle plates, adapted to move along said numbered spaces on each of said streets;

a spinner speedometer mechanism having an octagon shape and adapted to indicate a metric vs. miles conversion, said spinner further indicating the number of spaces that a player may move said playing pieces;

a plurality of color-coded, player directive symbols strategically located on the spaces of said streets, each of said color-coded symbols providing instructions to the player who lands in the space associated with such symbols, a selected number of said symbols instructing said player to utilize one of said playing cards; and a plurality of decision cards including a motor vehicle card, a pedestrian card, a bicycle card, a good driver card, and a courtesy gas card.

2. The traffic complaint rules game as defined in claim 1 further comprising a plurality of mobile directional arrows on said streets and vehicle plate ends.

* * * * *